United States Patent [19]

Fink

[11] 4,330,026

[45] May 18, 1982

[54] METHOD AND DEVICE FOR CONTROLLING INJECTION PROCESS IN COLD-CHAMBER DIE-CASTING MACHINES

[75] Inventor: Roland Fink, Winterbach, Fed. Rep. of Germany

[73] Assignee: Oskar Frach Werkzeugbau GmbH & Co. KG, Winterbach, Fed. Rep. of Germany

[21] Appl. No.: 157,155

[22] Filed: Jun. 6, 1980

[30] Foreign Application Priority Data

Jun. 6, 1979 [DE] Fed. Rep. of Germany ..... 2922914

[51] Int. Cl.[3] ..... B22D 17/32

[52] U.S. Cl. ..... 164/457; 164/155; 164/113; 164/315

[58] Field of Search ..... 164/4, 155, 113, 119, 164/120, 312, 313–315

[56] References Cited

U.S. PATENT DOCUMENTS 4,019,561 4/1977 Aoki ..... 164/4 X

FOREIGN PATENT DOCUMENTS 51-28525 3/1976 Japan ..... 164/155

562380 9/1977 U.S.S.R. ..... 164/312

*Primary Examiner*—Robert D. Baldwin

*Assistant Examiner*—K. Y. Lin

*Attorney, Agent, or Firm*—Craig and Antonelli

[57] ABSTRACT

A method and apparatus for controlling an injection process in cold-chamber die-casting machines which work on a three-phase system whereby an automatic initiation of the third phase without delay is possible. Beginning with the plunger of the apparatus in a certain starting position, the time is measured which elapses until a pressure in a working cylinder ahead of the plunger has reached a predetermined value. The time delay of the valve system which releases the pressure medium feed in the third phase is subtracted from the time measured so as to arrive at a time differential. At the end of the time differential, which elapses when the injection process begins with the plunger in its original or starting position, serves as a starting signal to trigger the valve system.

9 Claims, 3 Drawing Figures

METHOD AND DEVICE FOR CONTROLLING INJECTION PROCESS IN COLD-CHAMBER DIE-CASTING MACHINES

The present invention relates to a method and apparatus for controlling an injection process in cold-chamber die-casting machines.

Modern injection assemblies on die-casting machines work as a so-called 3-circuit or 3-phase system. In a first phase, a plunger is moved forward together with a batch of material being pumped with a second phase being initiated by a second pressure circuit with a separate reservoir, whereby the phase is initiated as a function of the distance travelled by means of a limit switch which is actuated by the plunger. A third phase is initiated by pressurization of a third pressure circuit, which circuit includes an additional pressure reservoir. The third phase plays a critical role in the overall quality of the cast products in the casting process.

In this connection, the third phase must be initiated immediately after the second phase, which terminates the process of injection and filling of the entire mold. Presently, there are several possibilities for initiating the third phase.

More particularly, one possibility resides in the initiation of the third phase in a transition from the second phase to be third phased as a function of pressure. In other words, the third pressure circuit is activated when the pressure in the working cylinder has reached a predetermined value whereupon a check valve is opened to a storage tank and thereby open a seat valve which initiates the third phase.

A further possibility for initiating the third phase resides in the initiation of a third phase in the transition from the second phase to the third phase as a function of travel or displacement. More particularly, a limit switch may be provided which opens a seat valve when the plunger is in a certain position by virtue of the fact that an electromagnetically operated valve permits the pressure to flow to the valve seat actuated by this pressure.

While the initiation of the third phase in the transition of the second phase to the third phase as a function of pressure is in fact positive, such a possibility suffers from the disadvantage that the switching time of the pressure response valve, which operates as a function of pressure, delays the initiation of the third phase.

With the initiation of the third phase as a function of displacement or travel, when the limit switch is in a correct position, an optimum injection curve for the third phase is produced; however, in practice, it is necessary when effecting a transition as a function of travel, to make the injection curve visible on a special monitor. The limit switch for the initiation of the third phase is then adjusted while monitoring the injection curve until it is apparent from the injection curve that the third phase begins immediately after the second phase. This monitoring of the injection curve means that the correct point in time for actuating the control valve, which is activated as a function of displacement or travel, must be found and, consequently, a process such as this requires considerable experience and certain skills.

The aim underlying the present invention essentially resides in providing a method and apparatus for controlling an injection process in cold-chamber die-casting machines which dispenses with a manually controlled switching process and enables an automatic initiation of the third phase without delay.

In accordance with advantageous features of the method of the present invention, in a first phase, the mold is filled with the die-casting medium up to a slug, in the second phase, there is an injection to the end mold with an increase in pressure and, in the third phase, there is a pressure multiplication in the filled mold with the individual phases being controlled by means of at least one limit switch as a function of the travel of the plunger. The time is measured, beginning with the plunger at a certain starting position, which elapses until the pressure in the working cylinder ahead of the plunger has reached a predetermined value. The time delay of the valve device which triggers the supply of pressure medium in the third phase is determined and subtracted from the above-noted time. The end of this time differential, which elapses when the injection molding process starts with a plunger in the starting position, serves as a starting signal to trigger the valve system.

By virtue of the above-noted features of the present invention, an automatic adjustment of the initiation of the third phase to the second phase with a zero delay is possible. Moreover, the quality of the products manufactured in accordance with the method of the present invention can be kept high even though special trained operating personnel are not available for the automatic die-casting machinery.

An advantage of the method of the present invention resides in the fact that, when the amount of metal entering the die-casting chamber differs as a result of temperature variations in the melt, it is automatically equalized. The third phase is then initiated at the correct point in time with a zero delay.

It is possible to measure the time delay of the valve arrangement which permits the influx of the pressure medium during the third phase, for example, by using positioning valves with feedback. Thus, in a simple fashion, the time delay can then be preset as a constant according to empirical determination so that the devices for continuous determination of the time delay may be eliminated. It has been found that relatively good results can be achieved even when a fixed value is set for the time delay.

In accordance with advantageous features of the apparatus of the present invention for working the above-noted method, a limit switch, actuatable with the plunger in an initial position, is provided as an on switch and a pressure switch associated with the working cylinder is provided as an off switch for a timer. The timer is connected in series with a differential generator and a pre-selection-unit to determine or predetermine the time delay. At least one memory is provided to record the generated differential value and a comparator unit is provided for comparing the stored differential value with the time signal from the timer produced during the next injection process, and to trigger a signal when the times correspond. The output of the comparator controls the valve arrangements so as to permit the pressure medium to flow during the third phase and means are provided for erasing the memory.

Advantageously, in accordance with further features of the present invention, two memories may be provided for the differential value, which memories are alternately addressable by the differential generator so as to permit improved monitoring of the control process and to enable a processing which is less subject to failure.

Accordingly, it is an object of the present invention to provide a method and apparatus for controlling an injection process in cold-chamber die-casting machines which avoids, by simple means, shortcomings and disadvantages encountered in the prior art.

Another object of the present invention resides in providing a method and apparatus for controlling an injection process in cold-chamber die-casting machines which enables an automatic initiation of a third phase of the injection process without a time delay.

Yet another object of the present invention resides in providing a method and a device for controlling an injection process in cold-chamber die-casting machines wherein a third phase of the injection process is initiated as a function of travel.

A further object of the present invention resides in providing a method and apparatus for controlling an injection process in cold-chamber die-casting machines which is relatively simple and does not require highly trained operating personnel.

A still further object of the present invention resides in providing an apparatus for controlling an injection process in cold-chamber die-casting machines which is simple in construction and therefore relatively inexpensive to manufacture.

These and other objects, features and advantages of the present invention will become more apparent from the following description when taken in connection with the accompanying drawings which show, for the purposes of illustration only, one embodiment in accordance with the present invention, and wherein.

Figure 1:
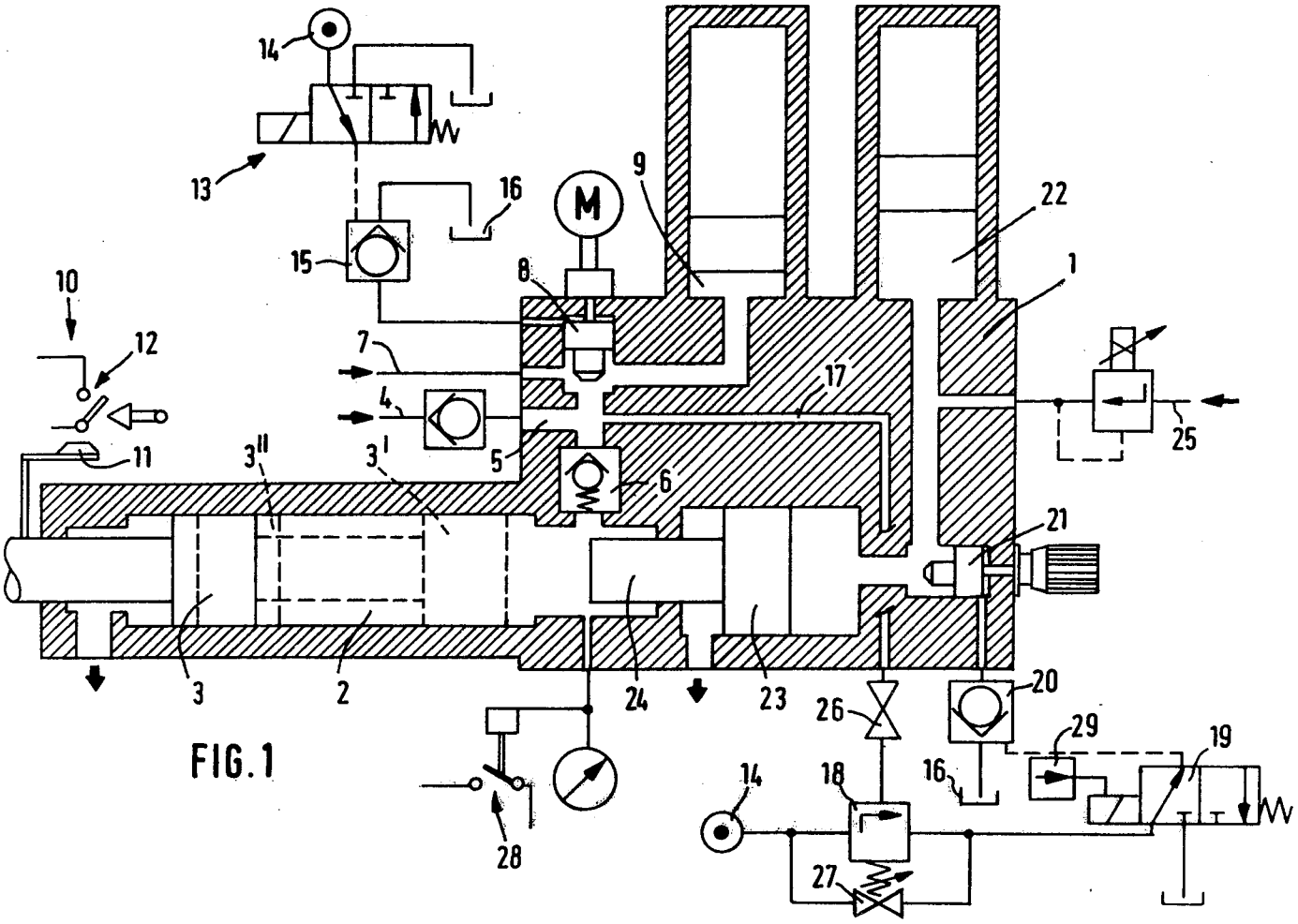
FIG. 1 is a schematic cross-sectional view of an injection molding device on a die-casting machine provided with a control apparatus in accordance with the present invention.

Before describing, in detail, the particular improved method and apparatus for controlling injection process in cold-chamber die-casting machines in accordance with the present invention, it should be observed that the present invention resides primarily in a novel structural combination of conventional components and not in the particular detailed configurations thereof. Accordingly, the structure, control and arrangement of these conventional components and circuits have, for the most part, been illustrated in the drawings by readily understandable schematic representations, which show only those specific details that are pertinent to the present invention, in order not to obscure the disclosure with structural details which will be readily apparent to those skilled in the art having the benefit of the description herein. Additionally, a block diagram illustration of FIG. 3 does not necessarily represent the mechanical structural arrangement of the exemplary system, but is primarily intended to illustrate the major structural components of the control apparatus of the present invention in a convenient functional grouping, whereby the present invention can be more readily understood.

Referring now to the drawings wherein like reference numerals are used throughout various views to designate like parts, and more particularly, to FIG. 1, according to this figure, an injection molding device is provided on a die-casting machine with the machine being equipped with a conventional pressure-dependent control arrangement for initiation of the third phase and, alternatively, with a control apparatus in accordance with the present invention with essentially only those valve systems being illustrated by means of which the control processes may be initiated.

More particularly, as shown in FIG. 1, a plurality of pistons and valve devices are disposed in a pressurized housing, with the pistons and devices being provided to implement the above-noted three phases during the die-casting process. A plunger 3 is displaceably mounted in a working cylinder 2 with an end (not shown) of the plunger 3 cooperating, in a conventional manner, with an injection chamber of the cold-chamber die-casting machine. Depending upon the movement and pressurization of the plunger 3, the molten metal is supplied to molds (not shown) and pressurized so as to produce a high quality die-cast product.

To initiate a first working phase of the die-casting process, a pressure medium is conducted through a line 4 to a bore 5 and to working cylinder 2 through a check valve 6. As a result of the conducting of the pressure medium, plunger 3 is transported from the position designated 3', indicated by phantom lines, for filling the molds with die-casting medium to a position designated 3'' a short distance from the molds for casting, whereupon pressure medium is added through a line 7 from a second pressure medium circuit to initiate the second phase and, after a displacement of a seat valve 8, pressure medium is guided from a reservoir 9, at high pressure and at high speed, into the working cylinder 2, so that the casting material, which is in the mold, is rapidly injected therein.

The control or displacement of the seat valve 8 is accomplished as a function of the position designated 3'' of the plunger by means of a limit switch generally designated by the reference numeral 10 which includes, in a conventional fashion, a stop 11 which is connected permanently to the plunger 3 and an electrical switch generally designated by the reference numeral 12 which is actuated by a stop. A solenoid valve generally designated by the reference numeral 13 is brought into the position shown in FIG. 1 by means of the electrical switch 12, in which position a check valve 15 is opened to pressure medium from a control reservoir 14 so that pressure medium may flow back from a chamber above the seat valve 8, which is initially in a closed position, into a tank 16 whereby the seat valve opens a connection or communication from the reservoir 9 to the check valve 6 and the working cylinder 2.

The third phase of the injection process may be initiated in a conventional manner, for example, when a certain pressure is reached in the working cylinder 2, a threshold value switching valve 18, in a connecting bore 17 opens thereby permitting pressure medium to flow through the auxiliary pressure reservoir 14 and control valve 19 to a check valve 20, thereby connecting the chamber on a right side of a seat valve 21, in exactly the same manner described hereinabove in connection with the seat valve 8 and check valve 15, so that additional pressure medium existing in an additional pressure medium reservoir 22 may be fed to a multiplier piston 23 and, from the piston 23 through a piston 24 to the working cylinder 2 utilizing a translation ratio. The plunger 3 which is then in an extended end position, subjects the die casting material, already injected into the mold, to a very high pressure whereby high-quality castings are produced in a conventional manner. The pressure medium circuit for the third phase is connected to the pressurized housing 1 by a pressure medium line 25. To initiate a pressure-dependent control process, the valve 26 is opened and the valve 27 is closed to bypass the threshold value switching valve 18.

A disadvantage of a control such as described hereinabove resides in the fact that, as a result of the switching times of the valves 18, 19, 20 and 21, there must be a relatively long time delay until the third phase is initiated and this is known to lead to defects in the castings.

Accordingly, the injection assembly is, as shown in FIG. 1, further provided with a switch generally designated by the reference numeral 28, of conventional construction, which switch is adapted to be actuated as a function of pressure and which is adapted to produce an electrical signal when a certain pressure is reached in the working cylinder 2. Upon generation of such signal, the valve 26 is closed and the valve 27 is open so that the threshold value valve may be bridged.

Figure 2:
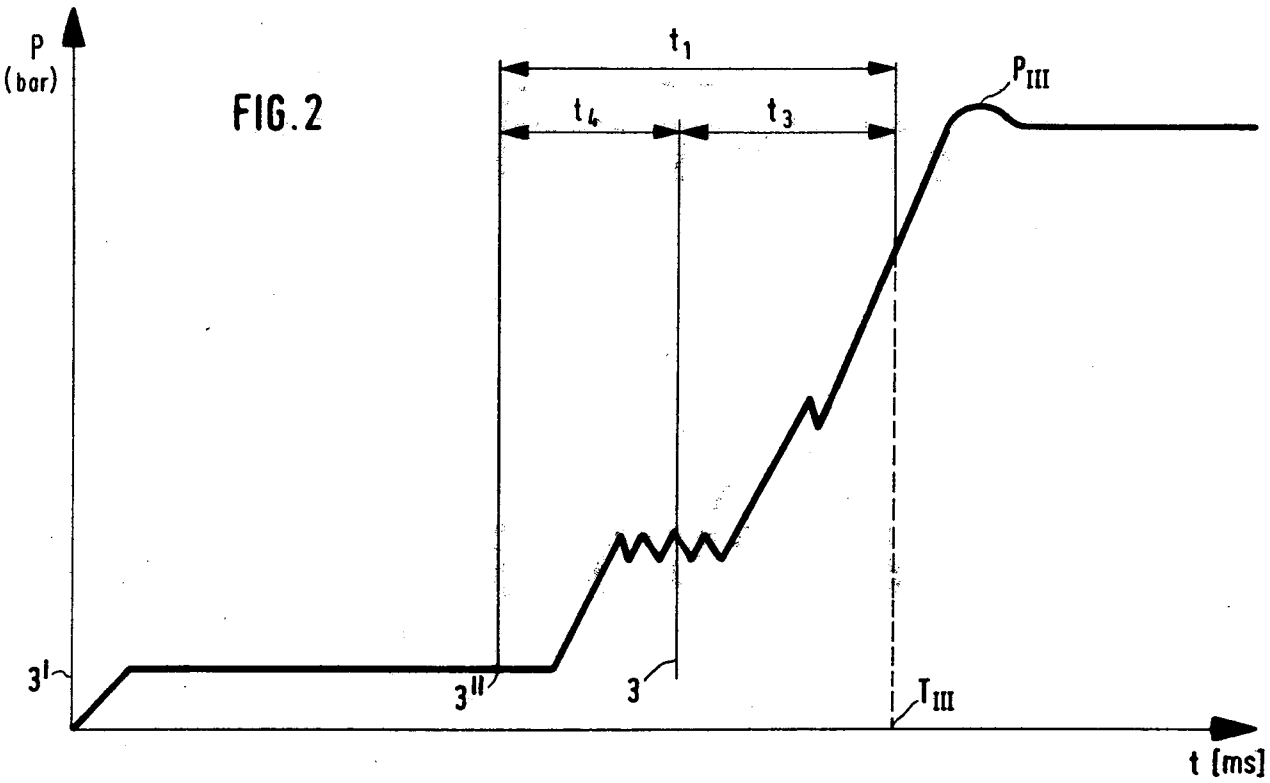
FIG. 2 is a graphical representation of a pressure cycle in a working cylinder of the injection molding device of FIG. 1 as a function of time, graphically depicting the method of the present invention.

In accordance with the present invention, the third phase is initiated as follows:

As is apparent from FIG. 2, wherein the pressure in the working cylinder is plotted as a function of time, it can be seen that when the plunger 3 reaches a certain position corresponding to the position designated 3'' (FIG. 1), the second phase is initiated by the limit switch 10 in the manner described hereinabove. From this point on, as can be seen in FIG. 2, the time $t_1$ is measured with the time $t_1$ representing the time elapsed until a certain pressure of, for example, 140 bars, is sensed or indicated in the working cylinder 2 by the pressure switch 28.

The present invention is based on the fact that the start of the third phase, if no delay in the pressure rise is to occur, must take place within the time interval $t_1$ such that after the time interval $t_1$ has elapsed, the valve system 19, 20 and 21 has permitted the pressure medium to reach the multiplier piston 23. This assumes that the solenoid valve 19 must be pressurized within the time interval $t_3$ before this end point is reached, which time corresponds to the time delay for the response of the valve system. This delay or time interval $t_3$, for example, can be determined by the fact that a valve with a position feedback is provided for the switching valve 19, which valve makes it possible to measure the time delay directly or that the time delay of the valve system in question is determined empirically for a predetermined die-casting machine. The value of the time delay may, for example, be a constant and is subtracted from the time interval $t_1$ found earlier for the injection process. During the subsequent injection process, in other words, when the plunger 3 completes its stroke starting at the starting position, the second phase is again initiated by the limit switch 10 while the third phase is initiated after a time interval $t_4$ has elapsed by virtue of the fact that the solenoid switching valve or control valve 19 is actuated by transistor-amplifier stages 29 of the control apparatus of FIG. 1. This insures that at the time $T_{III}$, the desired pressure multiplication up to a value of $P_{III}$ is accomplished without a pressure drop taking place during a transition from the second to third phase of the injection process. The pressure curve shown in FIG. 2 permits high-quality castings to be manufactured and, since the injection process is controlled automatically, a constant quality is insured as well.

Figure 3:
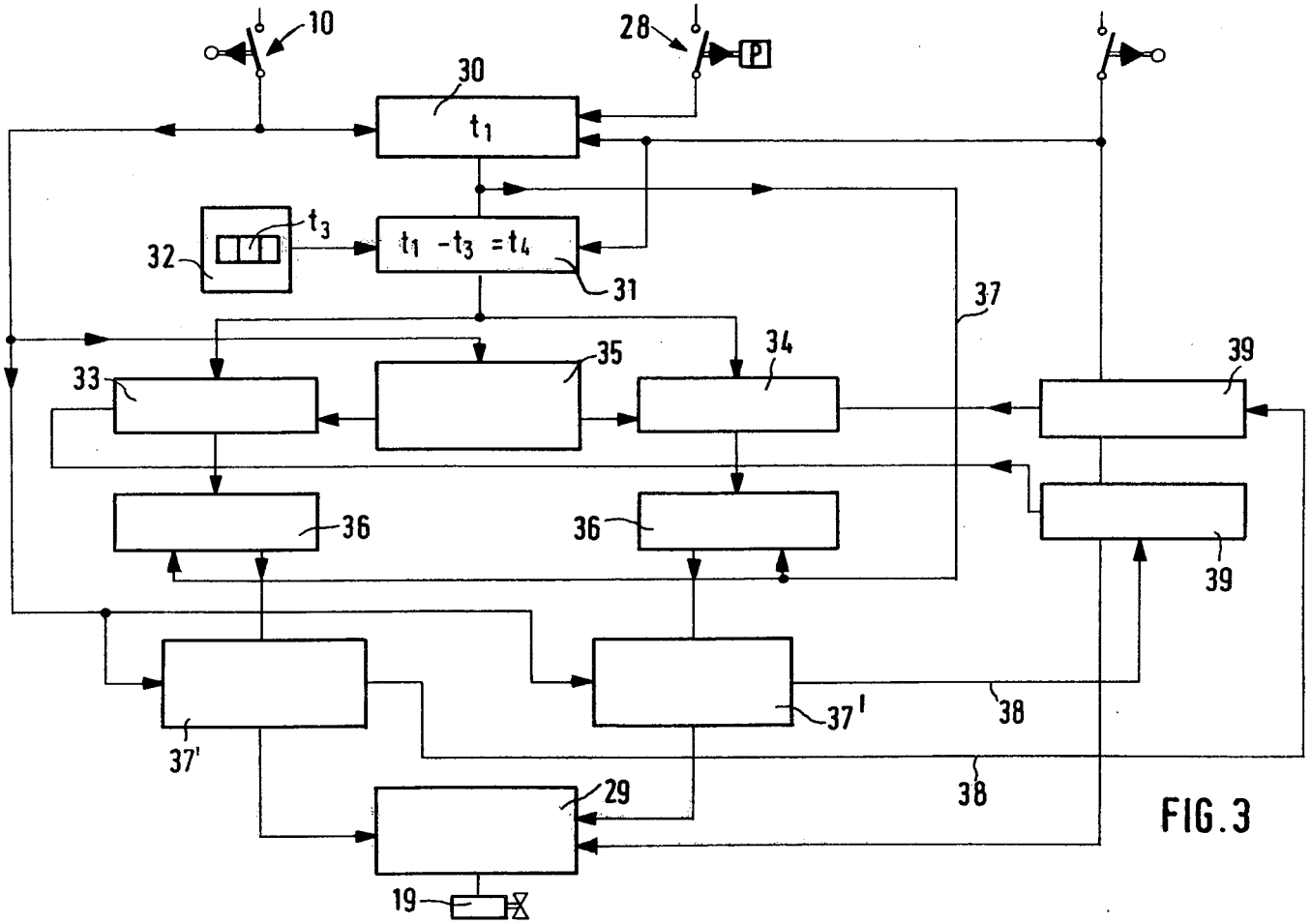
FIG. 3 is a schematic block diagram of the control apparatus of the present invention for carrying out the process of the present invention.

FIG. 3 provides a block diagram of a control apparatus for carrying out the method of the present invention. It will be apparent from a review of this figure that both limit switch 10 associated with the plunger 3 and switch 28 which is actuated as a function of pressure, are connected in series with a timer 30 whereby the timer is turned on by the limit switch 10 as a function of travel of the plunger 3 and is turned off, as noted above, as a function of pressure by the switch 28. The time interval $t_1$ which elapses between the turning on and turning off of the timer 30 is fed to a BCD-arithmetic-unit or differential generator 31 to which a value of the time constant or time interval $t_3$, determined empirically in the illustrated embodiment, is supplied from a preselection-unit 32. The differential generator 31 generates the differential $t_1-t_3=t_4$ and then stores this value in the memory 33 or, alternatively, in the memory 34. Therefore, each time they are triggered by the limit switch 10, the memories 33 and 34 are opened by a flip-flop 35 to store the determined values of $t_4$.

A comparator unit 36 is connected in series with each memory 33 and 34 with the comparator unit also being controlled by the timer 30 through a connecting line 37. Therefore, when the first injection process is complete and the following injection process is initiated, the value for the time interval $t_4$ from the memory is compared with the continuous and continuously increasing value of the time interval $t_1$ from the timer 30, depending on whether memory 33 or 34 is being used. When the value of the time interval $t_1$ reaches a value of the time interval $t_4$, the comparator 36 generates a switching signal which actuates the transistor-amplifier-stage 29 through an appropriately connected logical-unit 37', which is realized with AND-gates, with the transistor-amplifier-stage 29 actuating the valve 19 once again in the manner described hereinabove. Therefore, as shown in FIG. 2, the valve 19 is actuated after the time interval $t_4$ so that the third phase follows the second phase with a zero delay at the time $T_{III}$.

When the logical-units 37' receive output or switching signals from the corresponding comparators 36, the logical-units 37' are starting by way of lines 38, eraser-pulse-generators 39 which are adapted to erase the corresponding memories 33 or 34 and also erase the values still present in the timer 30 and in the differential generator 31 from the previous timing process.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A method of controlling an injection process in cold-chamber die-casting machines, the method comprising the steps of filling a mold up to a slug with a die-casting medium in a first phase of the injection process, injecting the die-casting medium into an end mold with a pressure rise in a second phase of the injection process, multiplying the pressure in the filled mold during a third phase of the injection process, and controlling the individual phases as a function of travel of a plunger of the die-casting machine characterized by measuring a time interval, beginning with the plunger at a certain starting position, which elapses until a pressure in a working cylinder ahead of the plunger reaches a predetermined value, determining a response time delay of a valve means for controlling a supply of the pressure medium in the third phase, subtracting the response time delay from the time interval so as to obtain a time differential value, triggering the valve means for controlling the supply of pressure medium in the third phase of the injection process in response to the time differential value which elapses after the injection molding process begins with the plunger in the starting position.

2. The method of claim 1, wherein the step of controlling the individual phases includes monitoring a position of the plunger by at least one limit switch means.

3. The method of one of claims 1 or 2, wherein the response time delay is a constant, supplied by a preselection-means.

4. An apparatus for controlling an injection process in a cold-chamber die-casting machine wherein a mold is filled with a die casting medium in a first phase of the injection process, the apparatus comprising a working cylinder, a plunger means displaceably mounted in the working cylinder for injecting the die-casting medium into an end mold with a pressure rise during a second phase of the injection process, multiplying piston means acted upon by a pressure medium and cooperable with the plunger means so as to increase the pressure in the end mold during a third phase of the injection process, valve means for controlling a supply of pressure medium acting upon the multiplying piston means, limit switch means actuatable by the plunger means when the plunger means is in a starting position, means for determining a pressure in the working cylinder at a position ahead of the plunger means, a timer means operatively connected with the limit switch means and the pressure determining means in such a manner that the timer means is turned on by the limit switch means and turned off by the pressure determining means so as to provide time signals for each injection process, means for supplying a delay response time of the valve means, a differential generator means connected in series with said delay response time determining means and in series with said timer means for generating a differential time value in response to signals received from the timer means and the delay response time determining means, a comparator means connected to the differential generator means and the timer means for comparing a differential time value received from the differential generator means with a time signal provided by the timer means during a following injection process and for providing an output signal for activating the valve means so as to permit a flow of the pressure medium during the third phase of the injection process when the stored differential time value corresponds to the time signal received from the timer means.

5. An apparatus according to claim 4, wherein at least one memory means is interposed between the differential generator means and the comparator means for receiving and storing the time differential value and for providing an output signal of the time differential value to the comparator means.

6. An apparatus according to claim 5, wherein means are provided for erasing said memory means.

7. An apparatus according to claim 5, wherein two comparator means are provided, a memory means is interposed between each comparator means and differential generator means for receiving and storing the time differential values and for providing an output signal of the time differential value to the respective comparator means.

8. An apparatus according to claim 7, wherein the respective memory means are alternately addressable by a flip-flop means.

9. An apparatus according to claim 8, wherein means are provided for erasing the respective memory means.

* * * * *

UNITED STATES PATENT AND TRADEMARK OFFICE

CERTIFICATE OF CORRECTION

PATENT NO. : 4,330,026

DATED : May 18, 1982

INVENTOR(S) : Roland FINK

It is certified that error appears in the above—identified patent and that said Letters Patent is hereby corrected as shown below:

Title page left-hand column, in the "Assignee" data ("[73]"), delete "Winterbach,".

Signed and Sealed this

*Fifth* Day of *April 1983*

[SEAL]

*Attest:*

GERALD J. MOSSINGHOFF

*Attesting Officer*

*Commissioner of Patents and Trademarks*